United States Patent [19]

Nicholson

[11] Patent Number: 4,726,568

[45] Date of Patent: Feb. 23, 1988

[54] EASILY STORED AND USED DISPOSABLE COVER FOR A MOLTEN METAL LADLE

[75] Inventor: Edwin R. Nicholson, Chesterton, Ind.

[73] Assignee: Crisman Sand Company, Inc., Portage, Ind.

[21] Appl. No.: 578,622

[22] Filed: Feb. 9, 1984

[51] Int. Cl.[4] ..... C21C 5/42

[52] U.S. Cl. ..... 266/275; 266/287

[58] Field of Search ..... 266/287, 903, 280, 165, 266/271, 275, 248, 286; 206/816; 428/920; 52/3, 5; 160/238, 237, 368 G, 368 R, 23 R

[56] References Cited

U.S. PATENT DOCUMENTS

| | | | |
|---|---|---|---|
| 3,499,680 | 3/1970 | Stroebel | 160/238 |
| 3,856,072 | 12/1974 | Sand | 160/238 |
| 4,381,855 | 5/1983 | Ryan | 266/287 |
| 4,390,170 | 6/1983 | Schaefer, IV et al. | 266/286 |
| 4,424,956 | 1/1984 | Grant et al. | 266/287 |
| 4,424,957 | 1/1984 | Grant et al. | 266/287 |

*Primary Examiner*—L. Dewayne Rutledge
*Assistant Examiner*—S. Kastler
*Attorney, Agent, or Firm*—Richard G. Kinney

[57] ABSTRACT

An easily stored and used disposable cover for the opening of a molten metal type ladle is disclosed, which uses transverse ribs of green hardwood above a blanket made up of ceramic fabric batting. The ribs are tied together into an array by means of flexible wires running longitudinally across the ribs and secured to them. The ribs are sized to span across the ladle opening and to hold the blanket thereover, and the cover may be easily rolled up longitudinally so as to assume an easily stored, handled and shipped roll shape. A plurality of wide headed nails hold a sheet of plastic or like material and the blanket to the ribs. The sheet serves to protect the blanket from tearing or catching or binding together and allows it to be unrolled and handled more easily. A wire end handling loop is also provided at the longitudinal ends to aid in placing the cover over the ladle.

13 Claims, 4 Drawing Figures

EASILY STORED AND USED DISPOSABLE COVER FOR A MOLTEN METAL LADLE

BACKGROUND OF THE INVENTION

1. Field of the Invention

This invention relates to the art of closures for ladles of the type used for carrying molten metal, including ladle cars and, more particularly, to a new and improved disposable cover for closing the opening of a preheated ladle car for retaining the heat therein after heating and before pouring molten metal therein.

2. Description of the Prior Art

The present invention finds its primary use with ladle cars, also called torpedo cars from their shape, transfer cars from their function, and Pugh ladles after their originator (U.S. Pat. No. 1,488,436). Such ladles are used in steel mills and like plants for moving molten metal from one location to another, for example, from a blast furnace to a continuous caster. U.S. Pat. No. 3,661,374 depicts one such ladle car. The cars have an opening and are conventionally rotatable along their long axis for discharging metal from the opening. Such cars, as is the case with conventional ladles for molten metal, are lined with a refractory material. To prevent damage to this material when the extremely hot molten metal is poured into the ladle, the ladle is conventionally preheated. This is often done by inserting gas burners into the opening of a partially rotated ladle and heating the interior over a period of time to raise the lining temperature.

Now it often occurs that the heating station. for the ladle is located a good distance from the source of metal or that because of scheduling delays or convenience in use, the car may have to wait a period of time before it is used. While permanent covers for ladles (e.g., U.S. Pat. No. 1,488,026) and Pugh ladles (U.S. Pat. No. 4,298,191) have been suggested, in practice, it is more efficient to prevent the waste of heat and, more importantly, the lowering of the lining termperature by using disposable lids or plugs.

Such coverings can also be used to cover molten metal containing ladles to prevent heat loss from the metal during transfer. In use, molten metal is poured through such coverings (melting upon contact the coverings and chicken wire).

A third and major use of such a covering is to conserve heat and maintain the temperature of a ladle after it has discharged its load of molten metal and while it is being returned for a second load.

It has been the practice to use ceramic batting reinforced in one or both sides with chicken wire. In one common form, this takes the shape of an oval or rectangular blanket that is laid over the mouth or opening of the ladle car. Such oval blankets are stored and shipped folded over in a half-moon shape.

In use, these blankets tend to sag or deform as the chicken wire stretches and softens as its temperature rises, tending to form an opening or openings through the blanket. Also, the lightweight blanket tends to blow off, partially or wholly, when subjected to gusts of winds often present in and around steel mills, especially when the car is being moved about, e.g., from the preheating station to a blast furnace. Thus, openings tend to form, resulting in a loss of heat.

It has also been suggested in U.S. Pat. No. 4,390,170 entitled Closure Plug for Ladle Car to form the chicken wire blanket into a conical shape that plugs the opening more or less like a cork in a bottle.

However, this construction would also tend to sag, especially as the chicken wire is placed on the underside of the plug. When used as described over ladle cars filled with molten metal, there is the possibility of having the plug bottom dissolved by contacting the molten metal.

One disadvantage of such prior closures is the difficulty of handling, storing, and transporting them. The typical blanket may be about 6×10 feet in size and even when folded over is a 6×5 foot unit. The conical shape suggested by the above-mentioned patent, while perhaps stackable in a nested array, would still be bulky and difficult to store, ship, and handle. Further, the ceramic batting of the insulation is relatively fragile and easily torn by contact with sharp edges or points during storage and handling. Thus, bulkiness in storage and difficulty in handling are significant disadvantages. Further, the chicken wire surface tends to "grab" or snag easily, making handling, as well as stacking or nesting, difficult.

Also, the unprotected insulation of prior covers while relatively non-absorbent of moisture, if exposed to rain or other sources of water during storage or handling, can entrap water droplets. This liquid when exposed to the high heat as when the cover is placed over a hot ladle can flash into steam with resulting damage to the insulation. Moisture can also cause the cover to deteriorate while in storage.

SUMMARY OF THE INVENTION

In overcoming one or more of these disadvantages of the prior art, the present invention provides for a heat-retaining, disposable cover for a ladle having an opening for receiving molten metal, which cover includes a blanket of flexible ceramic batting insulating material sized and shaped to cover and overlap the ladle opening; a plurality of rigid transverse support ribs, such as supports of hardwood positioned generally parallel to one another and spaced along the top of the blanket and secured cured to it, the ribs being sized to at least span the ladle opening when the cover is positioned on it, and flexible longitudinal supports such as a pair of spaced apart transverse steel wires affixed to the ribs for preventing them from transversely spreading and for securing them together; and means for allowing the cove to be easily secured to the ladle, whereby the cover may be rolled up transversely for ease of storage and transport and still be easily unrolled and dropped in place and secured over the ladle opening.

The present inventor has discovered that hardwood ribs of aobut 1×1¼ inches when used as taught by the present invention, do not, even after hours of use of the cover over a heated ladle, burn or weaken, nor tend to sag. Yet, when molten metal is poured through the cover, the ribs are readily consumed, offering no hindrance to the use of the ladle.

In accordance with another feature of the invention, a layer of plastic, or like consumable sheet material, is provided secured to the bottom of the blanket. This provides some structural strength and a smooth bottom surface to aid in rolling up the cover for storage and makes it easily handled as it reduces the propensity of the rolled or unrolled cover to snag or catch on objects. The layer of plastic also acts as a waterproof cover. This protects the cover from moisture and water while in transit, as well as in storage.

Additional features of the present invention which are believed to be novel are set forth herein-after. The invention, together with the further advantages thereof, may best be understood by reference to the following description taken in connection with the accompanying drawings, in the several figures of which like reference numerals identify like elements.

DESCRIPTION OF THE PREFERRED EMBODIMENT

Figure 1:
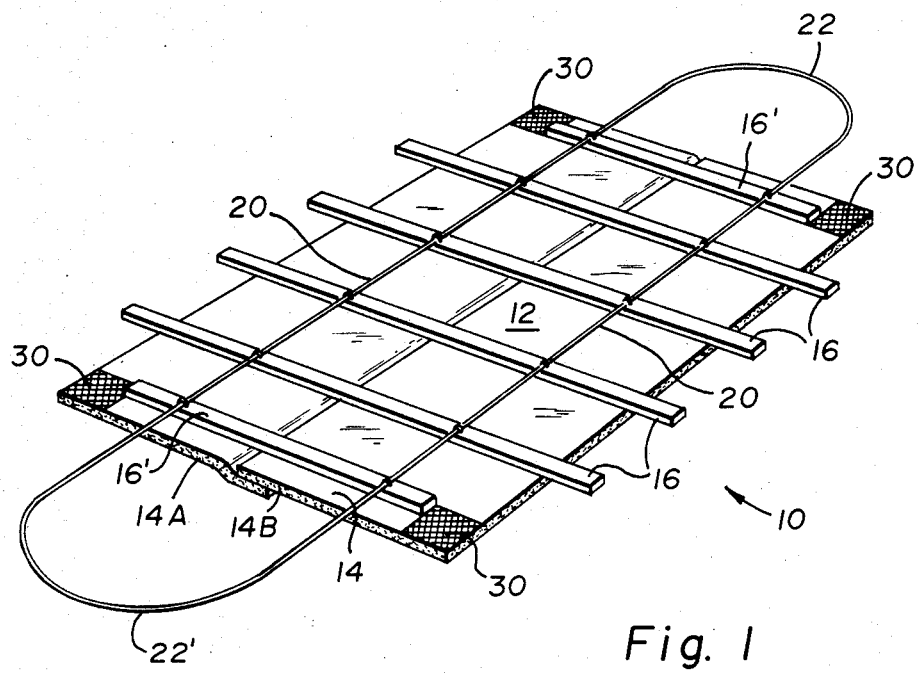
FIG. 1 is a perspective view of a heat-retaining, disposable cover constructed in accordance with the present invention.

Referring to FIG. 1, there is depicted an easily stored and used disposable cover constructed in accordance with the principles of the present invention, and generally designated by the number 10. The cover 10 is shown in its open or unrolled configuration as it would appear laid out on a floor or other flat surface 12 facing upward. In use, the cover 10 is placed over a ladle, with its bottom surface downward covering the opening.

The cover 10 comprises a blanket 14 formulated of flexible ceramic fiber insulating material batting. Such batting is available form the Carborundum Company of Niagara Falls, New York under the trademark Durablanket and also from Babcock & Wilcox Co., Insulating Products Division, Augusta, Georgia, under the trademark Kaowool. The blanket 14 may be formed of overlapping batting sections 14A and 14B as shown in FIG. 1, so as to gain a sufficient width. Basically, the blanket is sized to overlay on all sides of the ladle opening when placed centrally thereover and, thus, its dimensions depend on the ladle opening. A typical ladle opening on a Pugh car may be approximately 6×8 feet. For such an opening, a blanket 14 approximately 7 feet 6 inches by 10 feet has proven entirely satisfactory.

In accordance with one feature of the present invention, the cover 10 is provided with a plurality of transverse ribs 16 made of green hardwood, such as oak, which spans across the top of the blanket 14. The ribs 16 are arranged parallel to each other and are sized in length so as to also span the ladle mouth or opening when the cover is placed over it. The ribs 16 are preferably of a square or rectangular cross-section with 1×1¼ inches size being adequate for the particular sized blanket mentioned above, and are generally spaced apart from each other by an equal amount. The extreme ribs 16' are preferably spaced at a shorter distance from their adjacent ribs 16 and are somewhat shorter in length.

The ribs 16 are prevented from spreading apart from each other by means of flexible but relatively inelastic ties 20 which run perpendicular to the ribs 16 and are secured thereto at the points 22 of crossing the ribs 16. Seventeen-gauge steel wire is one example of suitable tying means 20. The ties 20 are preferably secured at about one-quarter and three-quarters of the transverse width of the cover 10, and serve to tie the ribs into a flexible framework that can be easily rolled up.

Means for handling the cover 10, namely, handling loops of wire 22 and 22' are provided at each end of the cover. These are preferably continuations of the tying wires 20. These handling means 22, 22' allow the cover 10 to be picked up and moved onto the ladle opening without the necessity of a worker closely approaching the hot opening.

As also shown in FIG. 1, the four corners of the cover 10 are provided with expanded metal mesh areas 30 on their upper surfaces. These areas 30 are secured to the ends of the shortened ribs 16' as by stapling or in any other convenient and effective manner, and serve as a nailing surface for allowing the corners to be nailed down onto the outer surface of a ladle by a stud gun.

While shown on the preferred expanded metal mesh, millboard and even burlap fabric could be used so long as the material of the surfaces 30 is sufficiently strong as to be boundable to the ribs 16' and to receive and hold the stud.

Figure 2:
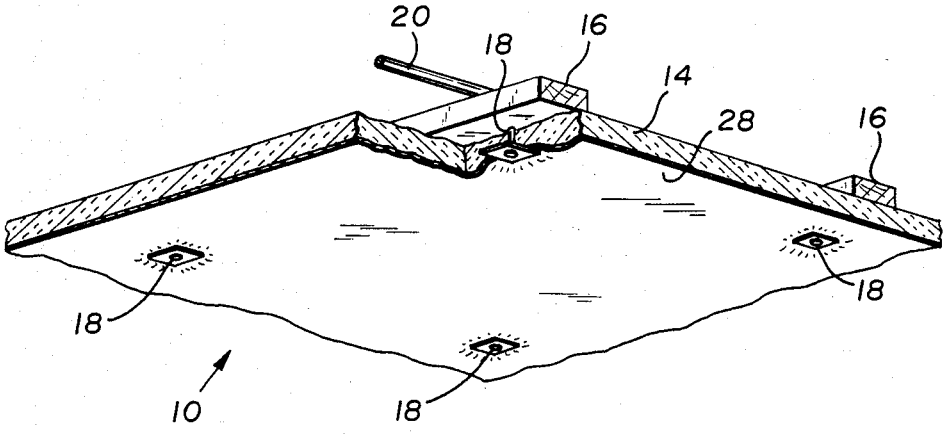
FIG. 2 is a cross-sectional perspective partial view of the cover of FIG. 1 showing a portion of the bottom.

Referring to FIG. 2, there is depicted a portion of the underside or bottom of the cover 10. Also shown are the means for securing the ceramic blanket 14 to the ribs 16, namely, a plurality of wide-headed nails 18. Such nails 18 may be made in one piece or formed by using a conventional headed nail and a suitable washer, e.g., one of thin metal sheet.

Figure 3:
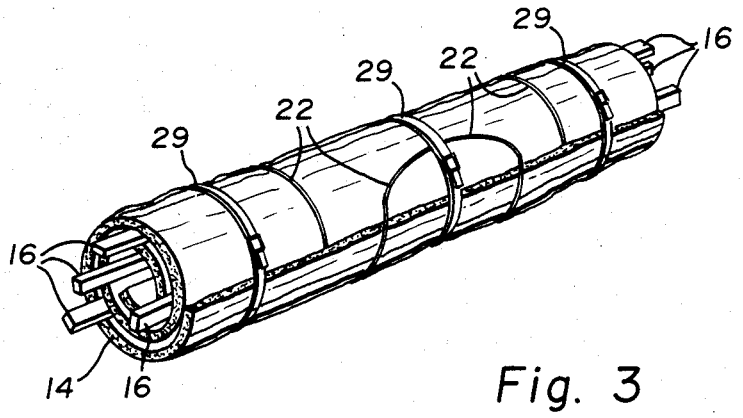
FIG. 3 is a perspective view of the cover of FIGS. 1 and 2 in its storage and shipping configuration.

As also shown in FIG. 2, the nails 18, also in accordance with one feature of the invention, secure a thin layer of sheeting 28 which is, as shown, preferably 4 mil. eurothane plastic sheeting, but may also be made of cloth, e.g., cheese cloth. The purpose of the sheeting is to protect the ceramic blanket 14 while providing a smooth, non-snagging bottom surface for allowing the cover bottom to easily slide over obstacles. Further, when rolled up for storage or shipping as shown in FIG. 3, the sheeting 28 is on the outside of the roll and serves to protect the cover. The sheeting, of course, that is exposed to the ladle opening, will readily and quickly vaporize and burn off, however, this represents no particular problem in use as it is the ribs 16 and ties 20 that provide the strength for the cover to span over the ladle opening.

As also shown in FIG. 3, the rolled-up cover 10 is preferably secured in its rolled up state by straps 29.

Figure 4:
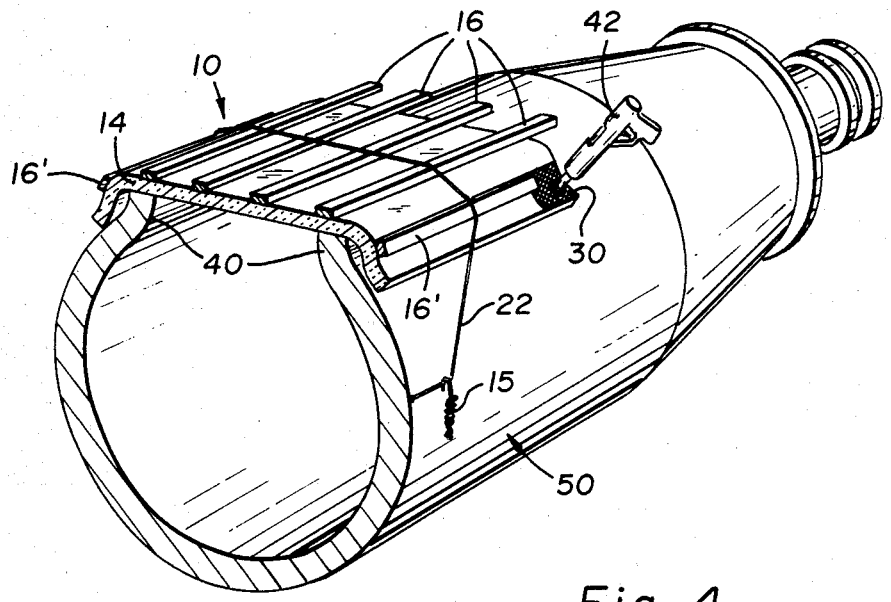
FIG. 4 is a partly perspective and partly sectional view of the cover of FIGS. 1 through 3 on a ladle for illustrating the method of use and methods of securing the cover in place.

As shown in FIG. 4, the cover 10 is positioned over a ladle opening 40 and is being secured by a stud gun 42 which is driving a stud or nail through the area 30. It may also be secured by means of a simple reusable hook and spring 15 affixed to the ladle 50 and capable of hooking on to the loop 22 or 22'.

Prior to the use and for storage and shipping, the novel cover 10 would be in the rolled-up state of FIG. 3. When desired to be used, it need only be unrolled to assume the state of FIG. 1 and by hand or machine lifted above a ladle 50, draped over its opening, and secured as shown in FIG. 4.

It should now be apparent that a new and improved disposable cover for a ladle has been described that is easy to handle, store, ship, and use while still providing effective heat retention, and is yet simple and inexpensive to make and use.

While particular emphasis has been placed herein on the embodiment illustrated in the drawings and certain modifications thereof, it will be appreciated that other embodiments of the invention as well as other modifications of the embodiment herein illustrated and described can be made without departing from the principles of the present invention. Accordingly, it is to be distinctly understood that the foregoing descriptive matter is to be interpreted merely as illustrative of the present invention and not as a limitation.

What is claimed is:

1. An easily stored and used heat-retaining disposable cover for a ladle of the type that has an opening for receiving molten matal, comprising:

a blanket of flexible ceramic batting insulating material formed in a manner so as to effectively constitue a continuous layer without opening or gaps, said blanket being sized and shaped so as to be able to extend beyond and overlap the opening of the ladle in width and length, and said blanket having a top and a bottom;

a plurality of ribs of hardwood positioned generally parallel to one another on the top of, and across, said blanket, said ribs being spaced apart from one another thereon, each of said ribs spacing approximately the width of the blanket under them and being of such a length as to span across the ladle opening when the cover is placed centrally thereover;

means for securing the blanket to said hardwood ribs;

flexible tying means laid out transversely to said ribs and secured thereto for preventing the ribs from transversely spreading away from one another along the surface of the blanket; and means for affixing the cover to the ladle over the opening, said cover having the ability to be rolled up transversely for ease of storage and transportation, yet easily unrolled and draped across and secured over the opening of the ladle when desired.

2. The invention of claim 1 wherein handling means are provided attached to the cover for allowing it to be easily picked up and handled by hand or poles for safe manipulation.

3. The invention of claim 1 wherein said ribs are approximately $1 \times 1\frac{1}{4}$ inches in thickness and several feet in length, said securing means for affixing the blanket of flexible ceramic batting is wide-headed nails, and said tying means is metal wire laid out in at least two generally parallel lengths spaced apart from each other and firmly secured to said ribs.

4. The invention of claim 1 wherein said tying means is metal wire laid out in at least two generally parallel lengths spaced apart from each other and firmly secured to said ribs, and handling means in the form of an end loop of wire is provided to at least one of the transverse ends and secured to the end rib.

5. The invention of claim 4 wherein the means for affixing the cover includes releaseable hooks that can be hooked on said end loop of wire.

6. The invention of claim 1 wherein the means for affixing the cover includes stud-receiving means affixed at the margins of the cover and secured to a rib, whereby a stud gun can drive a stud through said means and into the surface of the ladle after the cover is draped over the opening.

7. The invention of claim 6 wherein the stud-receiving means is expanded wire means.

8. The invention of claim 1 wherein a layer of flexible sheeting is secured to the bottom side of the batting layer to provide a smooth, non-snagging surface thereon during handling and, when the cover is rolled up with the bottom side out to facilitate its storage and shipping by providing plastic outer surface to the rolled cover.

9. The invention of claim 8 wherein said layer of sheeting is of waterproof material to protect the rolled-up cover from moisture and water.

10. The invention of claim 9 wherein said layer of sheeting is made of plastic.

11. A disposable cover for a molten metal ladle comprising a ceramic batting blanket layer with rigid transverse supports and flexible longitudinal supports so that the cover may be rolled up longitudinally for storage or shipping.

12. The invention of claim 11, wherein a sheet of smooth material is provided on at least the underside of the cover, whereby the cover may be more easily handled and placed on the ladle with less snagging.

13. The invention of claim 12, wherein said sheet is of plastic waterproof material and also serves to protect the rolled-up cover from water.

* * * * *

UNITED STATES PATENT OFFICE

CERTIFICATE OF CORRECTION

Patent No. 4,726,568 Dated February 23, 1988

Inventor(s) Edwin R. Nicholson

It is certified that error appears in the above-identified patent and that said Letters Patent are hereby corrected as shown below:

Column 2 - Line 42: delete "cured"

Column 2 - Line 47: delete "cove" and substitute "cover"

Column 2 - Line 53: delete "aobut" and substitute "about"

Column 5 - Line 7: delete "matal" and substitute "metal"

Signed and Sealed this

Sixth Day of September, 1988

*Attest:*

DONALD J. QUIGG

*Attesting Officer*

*Commissioner of Patents and Trademarks*